United States Patent [19]

Haushalter

[11] 4,052,955

[45] Oct. 11, 1977

[54] EMERGENCY BALLOON DEVICE

[76] Inventor: Nathan Haushalter, Box 7772, Longview, Tex. 75601

[21] Appl. No.: 721,352

[22] Filed: Sept. 8, 1976

[51] Int. Cl.[2] ..... G08B 5/00; G09F 9/00

[52] U.S. Cl. ..... 116/124 B; 116/DIG. 9

[58] Field of Search ..... 116/124 B, DIG. 44, 116/DIG. 9, 114 F; 40/214; 46/88, 90

[56] References Cited

U.S. PATENT DOCUMENTS

| | | | |
|---|---|---|---|
| 2,629,115 | 2/1953 | Hansen | 116/124 B |
| 2,842,090 | 7/1958 | Samwald | 40/214 X |
| 2,879,624 | 3/1959 | Benson | 46/90 X |
| 2,923,917 | 2/1960 | McPherson et al. | 116/124 B |
| 3,174,455 | 3/1965 | Peterson | 46/90 X |

FOREIGN PATENT DOCUMENTS

| | | | |
|---|---|---|---|
| 2,356,485 | 5/1975 | Germany | 116/124 B |

*Primary Examiner*—Daniel M. Yasich
*Attorney, Agent, or Firm*—Allen D. Brufsky

[57] ABSTRACT

An emergency balloon device includes a balloon member clamped onto a gas cartridge, wherein the gas cartridge is removably received into a cartridge holding section which is also capable of holding a plurality of smoke bomb cannisters. The cartridge holding device is removably received into a sleeve member which is secured to an end of a flexible cable; the other end of the cable is secured to a weighted base.

6 Claims, 3 Drawing Figures

EMERGENCY BALLOON DEVICE

BACKGROUND OF THE INVENTION

A number of U.S. patents relate to emergency signal devices. These U.S. patents are: U.S. Pat. No. 2,923,917 to McPherson, et al.; U.S. Pat. No. 3,002,490 to Murray; 3,592,157 to Schwartz; and U.S. Pat. No. 3,874,325 to Cocker. These aforementioned patents are non-applicable to my present invention.

SUMMARY OF THE INVENTION

My present invention relates to a unique and novel emergency balloon device.

An object of my present invention is to provide a means for marking the location of a person who is lost.

A still further object of my present invention is to provide a balloon that is readily identifiable, wherein the balloon is held in place by a cable and weighted base.

A still further object of my present invention is to provide a smoke generator means for the device.

Another object of my present invention is to provide a means for the activation of smoke generator means for the ground.

Briefly, my present invention comprises a balloon member clamp onto a gas cartridge, wherein the gas cartridge is removably received into a cartridge holding section which is also capable of holding a plurality of smoke bomb cannisters. The cartridge holding device is removably received into a sleeve member which is secured to an end of a felxible cable. The other end of the cable is secured to a weighted base.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
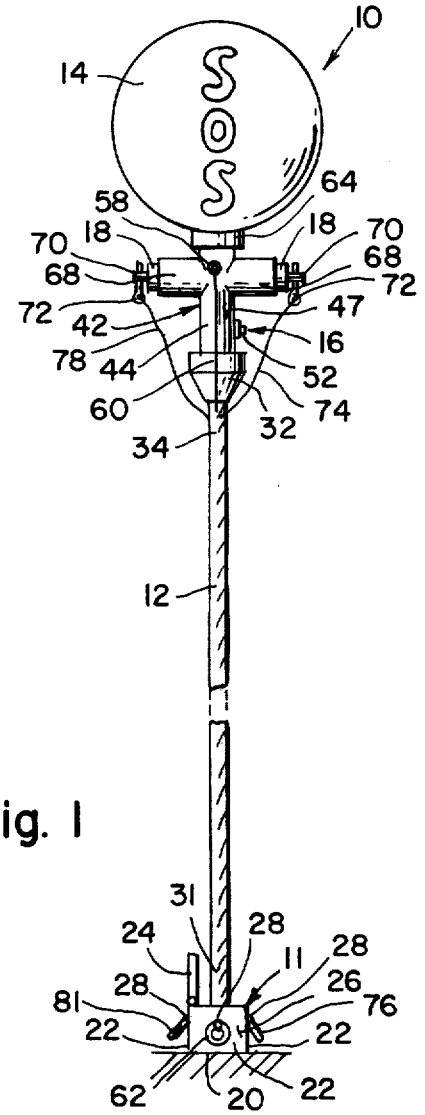
FIG. 1 illustrates a front view of an emergency balloon device.
Figure 2:
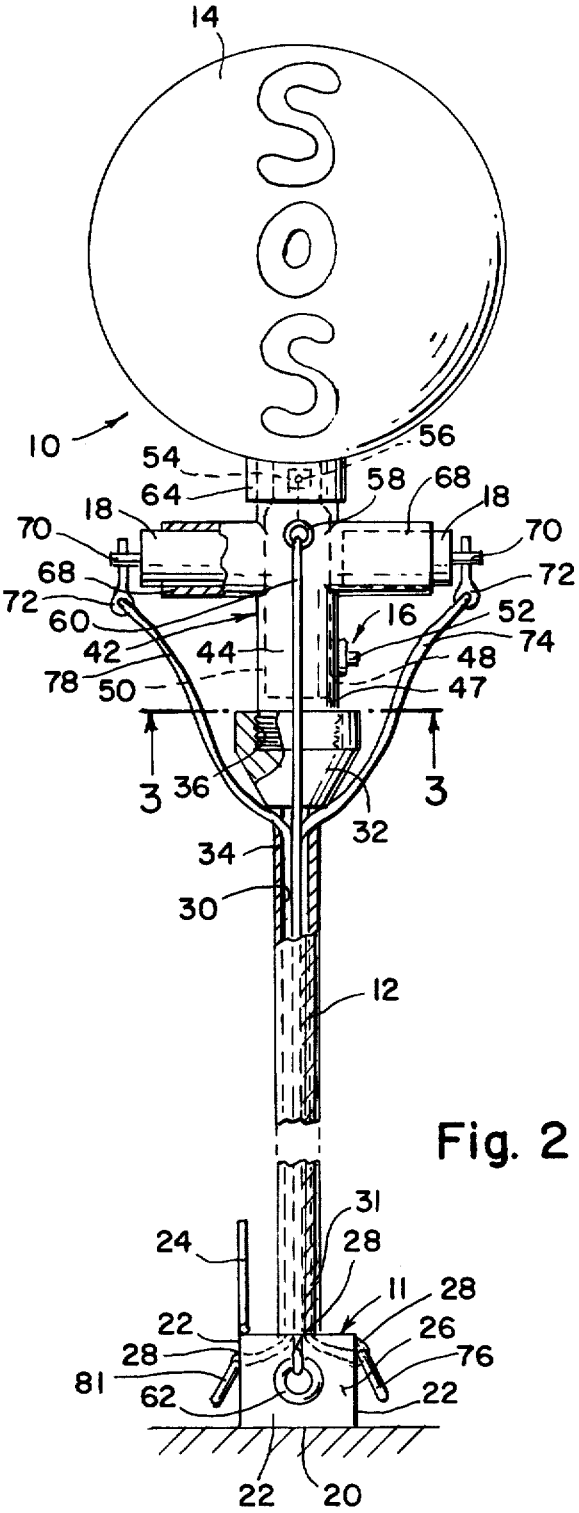
FIG. 2 illustrates a front cutaway view of the emergency balloon device.
Figure 3:
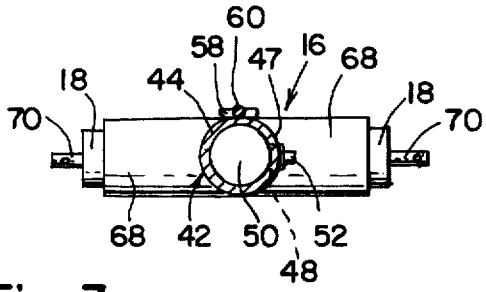
FIG. 3 illustrates an enlarged bottom view of a cartridge holding section of the device taken along lines 3—3 of FIG. 2.

Turning now descriptively to the drawings, in which similar reference characters denote similar elements throughout the several views, FIGS 1-2 show an emergency balloon device 10 used as a signal device for the easy detection of a person lost. The device 10 generally comprises a weighted base 11, a flexible lead cable 12, a balloon 14, a means 16 for inflation of the balloon 14, a plurality of smoke bomb cannisters 18, and a means for the individual activation of each cannister 18. The base 11 includes a bottom 20, a plurality of upwardly extending walls 22, and a hinged cover 24 thereby defining a chamber 26 therein, wherein at least three walls 22 have holes 28 therethrough. The metal lead cable 12 has a continuous bore 30 therethrough, wherein a lower end 31 of cable 12 is mounted within the base 11. A frustoconical shaped sleeve 32 is affixed to the upper end 34 of cable 12 wherein the interior periphery 36 of the sleeve is threaded. The stem 44 of a T-shaped tubular member

42 threadably engages into an upper end of sleeve 32, wherein a side wall 47 of stem 44 has an opening 48 therethrough. A cartridge 50 filled with a gas lighter than air is insertable into the upper end of stem 44, wherein a control button 52 of a gas discharge valve of the cartridge 50 extends outwardly through opening 48. A nozzle 54 of the cartridge 50 has a release valve element 56 therein as shown in FIG. 2 wherein the valve element 56 is joined to a ring element 58. One end of a first string member 60 is secured to ring element 58, wherein member 60 extends through the cable 12 and outwardly through one hole 28 of a first wall 22. To the bottom free end of member 60 is affixed a pull ring member 62. The neck of the balloon 14 is secured onto the nozzle 54 of the cartridge 50 by means of a ring clamp 64. The balloon is made for a white elastomeric material, wherein the letters "SOS" are disposed on an outer surface of the balloon 14. The letters are formed from an orange fluorescent paint. A smoke bomb cannister 18 is slideably received into each end of the tubular cross bar 68 of the tubular member 42. A valve mechanism 70 is disposed on the outer end of each cannister 18. A release pin 72 cooperates with each valve mechanism 70. The upper end of a second string member 74 is secured to the release pin 72 of one of the canisters 18, wherein member 74 extends through the cable 12 and outwardly through a hole 28 of a second wall 22. A second pull ring 76 is secured to the lower end of member 74. The upper end of a third string member 78 is secured to the release pin 72 of the other canister, wherein member 78 extends downwardly through the cable 12 and outwardly through a hole 28 in a third wall 22 of base 11. A third pull ring 81 is secured to a lower end of member 78.

In use, the flexible cable 12, balloon 14, gas cartridge 50, canisters 18 and clamp 64 are stored in the weighted base 11. The cover 24 is opened and the first string member 60 is tied to ring element 58. The balloon 14 is clamped onto the nozzle 54, wherein the cartridge is inserted into stem 44 of member 42. The two canisters 18 are inserted into the cross bar 68 of member 42. The second 74 and third 78 string members are tied to the release pins 72 of the canisters 18. The control button 52 is depressed allowing gas to discharge from the cartridge 50 into the balloon 14 thereby inflating the balloon 14 which causes the balloon 14 to move upwardly. The second pull ring 76 is pulled to release the pin 72 which causes the first canister 18 to dispense a smoke cloud outwardly. The third pull ring 81 is pulled to activate the second canister 18. The first pull ring 62 is pulled to activate release valve element 56 for deflation of the balloon 14.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the U.S. is

1. An emergency balloon device comprising:

a balloon, a T-shaped tubular member having a stem and a cross-bar, a cartridge having a gas lighter than air removably disposed within said stem, at least one cannister having a smoke substance disposed therein removably received within said cross bar for selective emmission of said smoke, means on said T-shaped tubular member for joining said cartridge and said balloon so that gas in said cartridge can selectively inflate said balloon, a flexible cable joined at one end by a sleeve member to said T-shaped tubular member, a weighted base joined to the other end of said flexible cable, and valve release means between said cartridge and balloon for selective deflating said balloon after said balloon has been inflated.

2. A device according to claim 1, wherein said balloon has the letters "SOS" disposed thereon.

3. A device according to claim 1, wherein said joining means is a ring clamp securing a neck of said balloon to a nozzle of said cartridge.

4. A device according to claim 1, wherein said base has a bottom, a plurality of upwardly extending walls and a hinged cover.

5. A device according to claim 1, wherein said deflation means further comprises:

a. a release valve disposed in said nozzle of said cartridge;

b. a ring element cooperating with said release valve; and c. a first string member secured to said ring element, said string member extending downward to said base.

6. A device according to claim 1 including activation means for each said cannister comprising:

a. a release pin cooperating with a valve of each said cannister; and b. a string element secured to each said release pin, each said string element extending downardly to said base.

* * * * *